US012275566B2

(12) United States Patent
Huizingh

(10) Patent No.: US 12,275,566 B2
(45) Date of Patent: Apr. 15, 2025

(54) CONTAINER WITH A SCREW CAP

(71) Applicant: Schoeller Allibert GmbH, Schwerin (DE)

(72) Inventor: John Huizingh, Vlagtwedde (NL)

(73) Assignee: Schoeller Allibert GmbH, Schwerin (DE)

( * ) Notice: Subject to any disclaimer, the term of this patent is extended or adjusted under 35 U.S.C. 154(b) by 102 days.

(21) Appl. No.: 18/128,407

(22) Filed: Mar. 30, 2023

(65) Prior Publication Data

US 2023/0312195 A1 Oct. 5, 2023

(30) Foreign Application Priority Data

Apr. 5, 2022 (DE) ..... 10 2022 108 162.1

(51) Int. Cl.

| | |
|---|---|
| ***B65D 43/02*** | (2006.01) |
| ***B65D 21/02*** | (2006.01) |
| ***B65D 41/34*** | (2006.01) |
| ***B65D 51/14*** | (2006.01) |
| *B65D 50/02* | (2006.01) |

(52) U.S. Cl.

CPC ..... *B65D 51/145* (2013.01); *B65D 43/0235* (2013.01); *B65D 50/02* (2013.01); *B65D 2255/20* (2013.01)

(58) Field of Classification Search

CPC ..... B65D 41/0442; B65D 43/0235; B65D 50/02; B65D 51/145; B65D 2255/20; B65D 2543/00972; B65D 2543/0074; B65D 43/0218; B65D 45/325; B65D 2255/06; B65D 2543/00518; B65D 2543/00555;

(Continued)

(56) References Cited

U.S. PATENT DOCUMENTS 2,602,565 A * 7/1952 Regan ..... B65D 41/08 220/259.3
3,491,908 A 1/1970 Beimers (Continued)

FOREIGN PATENT DOCUMENTS

DE 60005333 T2 4/2004
DE 10260225 A1 5/2004

(Continued)

OTHER PUBLICATIONS

Search Report received in German Application No. 10 2022 108 162.1 dated Jan. 24, 2023, with translation, 11 pages.

(Continued)

*Primary Examiner* — Gideon R Weinerth

(74) *Attorney, Agent, or Firm* — Christopher A. Rothe; CM Law

(57) ABSTRACT

A container, preferably in the form of a bucket, includes a closure for closing the container. The closure includes a closed lid plate that is placeable on a container rim bounding a container opening in order to cover the container opening. A lock ring is placeable over the lid plate and screwable to the container. The lid plate is fixable to the container with the lock ring. A seal ring is arranged between the container rim and lid plate for sealing the container opening. The lid plate has a rim portion with a receiving portion, in particular U-shaped, that receives the container rim and encompasses the container rim radially from the inside and outside.

20 Claims, 7 Drawing Sheets

(58) Field of Classification Search
CPC ..... B65D 2543/00398; B65D 2543/00407; B65D 2543/00092; B65D 2543/00296
USPC ..... 215/276, 352, 250, 252, 274, 221, 349; 220/304, 288, 319, 378, 259.3; 206/508, 206/807
See application file for complete search history.

(56) References Cited

U.S. PATENT DOCUMENTS 3,516,571 A * 6/1970 Roper ..... B65D 43/0212 206/508
4,126,246 A * 11/1978 Galer ..... B65D 43/0231 220/304
4,298,132 A * 11/1981 Galer ..... B65D 43/0231 215/217
4,518,097 A * 5/1985 Milton ..... B65D 1/46 206/508
4,679,696 A * 7/1987 Bonnenfant ..... B65D 51/145 215/276
4,694,970 A * 9/1987 Hayes ..... B65D 51/145 215/276
4,813,561 A * 3/1989 Ochs ..... B65D 41/3409 215/276
4,896,782 A 1/1990 Hawkins et al.
5,184,747 A * 2/1993 Nolte ..... B65D 39/082 220/288
5,207,345 A * 5/1993 Stewart ..... B65D 43/0229 220/326
5,346,082 A * 9/1994 Ochs ..... B65D 51/145 215/276
5,368,182 A 11/1994 Schutz
5,676,273 A * 10/1997 Jonkers ..... B65D 43/0225 220/284
5,875,915 A 3/1999 Bradshaw et al.
5,915,575 A * 6/1999 Morris, Sr. ..... B65D 50/046 206/508
5,944,214 A * 8/1999 Conti ..... B65D 43/0229 215/354
6,276,543 B1 8/2001 German et al.
6,477,823 B1 * 11/2002 Kitterman ..... B65D 41/0428 215/DIG. 1
6,591,998 B2 * 7/2003 Haynes ..... A61F 2/24 215/276
6,662,958 B2 * 12/2003 German ..... B65D 41/3423 215/276
7,090,088 B2 * 8/2006 Von, Jr. ..... B65D 21/0219 220/276
7,175,039 B2 * 2/2007 German ..... B65D 41/3423 215/350
7,611,026 B1 11/2009 Bloom et al.
8,162,165 B2 * 4/2012 Reed ..... B65D 55/02 220/288
9,156,597 B2 * 10/2015 Letica ..... B65D 50/066
9,359,117 B2 6/2016 Russell et al.
10,526,114 B2 * 1/2020 Vieker ..... B65D 85/70
2003/0098286 A1 5/2003 Bloom et al.
2003/0141271 A1 7/2003 German et al.
2004/0108294 A1 6/2004 Bloom et al.
2006/0091099 A1 5/2006 Klepac et al.
2006/0138156 A1 * 6/2006 Kellerer ..... B65D 43/0239 220/782
2008/0190803 A1 * 8/2008 Blumenschein ... B65D 43/0254 206/509
2011/0049155 A1 3/2011 Levine et al.
2012/0138562 A1 * 6/2012 Letica ..... B65D 43/0279 215/250
2017/0152078 A1 * 6/2017 Abate ..... B65D 43/0258
2023/0312195 A1 * 10/2023 Huizingh ..... B65D 45/30 220/304

FOREIGN PATENT DOCUMENTS

DE 60214662 T2 9/2007
EP 0323812 A2 7/1989
EP 0323812 A3 7/1989

OTHER PUBLICATIONS

Search Report received in European Application No. 23166373.3-1014 dated Sep. 5, 2023, with translation, 15 pages.

* cited by examiner

CONTAINER WITH A SCREW CAP

CROSS-REFERENCE TO RELATED APPLICATION(S)

This application claims priority under 35 U.S.C. § 119 to German Application No. 10 2022 108 162.1, filed Apr. 5, 2022, the content of which is incorporated by reference herein in its entirety.

FIELD

The present disclosure relates to a container, preferably a bucket sealable with a lid, in particular made of plastic, for transporting preferably hazardous materials.

BACKGROUND

Containers that are to be approved for the transport of dangerous goods have to meet certain requirements in order to obtain approval. The containers have to pass a drop test and an internal pressure test. In a drop test, the container is dropped from a certain height. When it hits the ground, the lid or the closure of the container must not open. In an internal pressure test, the closed containers have to withstand a certain pressure inside them without the container leaking or the closure or lid detaching from the container.

It is known to equip containers with closures consisting of a lid plate and a separate screw ring or lock ring with a thread.

A container is known from US 2006/0 091 099 A1, which has an inner plate that closes off an opening in the container. The plate is fastened with a lid which is screwed onto the container. At least one sealing element is prepared between the plate and side walls of the container. U.S. Pat. No. 7,611,026 B1 and U.S. Pat. No. 9,359,117 B2 also show containers in which a lid plate is screwed to the container by a lid with a thread.

These containers have in common that the protection against unintentional opening or respectively bursting open during the drop test is not sufficient. The plate, which is placed on the side walls of the container, may shift or deform under a high load. Furthermore, the side walls of the container may deform. Then the plate will no longer cover the entire opening of the container. As a result, the container may leak or, respectively, fail the drop test.

SUMMARY

It is therefore the object of the present disclosure to overcome or at least reduce the disadvantages of the prior art and preferably to provide a container which has a particularly secure closure. In particular, the container must not open during the drop test.

The present disclosure relates to a container having a closure for closing the container. The container may be a plastic container. Preferably, the container is in the form of a bucket. The closure or lid has a multi-piece configuration and comprises a lid plate, a lock ring, and a seal or seal ring (separate or formed on the lid plate). The closed, impermeable or fluid-tight and/or gas-tight lid plate serves to cover the container opening of the container and can be placed on a container rim bounding the container opening. The lock ring can be placed on or respectively above the lid plate and can be screwed to the container. The lid plate (placed loosely on the container) is fixed to the container by screwing on the lock ring. The seal or seal ring is arranged between the lid plate and the container rim and thus seals the container opening. Preferably, the lock ring presses the seal ring onto the upper edge of the container rim. This seals the transition between the container and the closure so that liquid cannot leak out. The seal ring may be molded or cast onto the lid plate or may be inserted or molded into the lid plate as a molded part.

The lid plate has a rim portion with a first receiving portion that receives the container rim and encompasses it radially from the inside and outside. The first receiving portion is preferably U-shaped, more precisely ∩-shaped (in the form of an inverted U).

The lid plate further has a circumferential projection or multiple projections provided in the circumferential direction. The projection or multiple projections may protrude radially outward from the first receiving portion of the lid plate and preferably extend further radially outward than the first receiving portion. The lock ring also comprises a circumferential projection or multiple projections provided in the circumferential direction. The projection or multiple projections protrude radially inward from a second receiving portion of the lock ring that is configured to receive or encompass the first receiving portion. Thus, the projection or multiple projections of the lock ring protrude towards the first receiving portion. During opening of the container or lifting of the closure, the projections of the lock ring and lid plate interact in a form-fit manner with each other in the axial direction.

In other words, projection or projections of the lid plate interact with the projection or projections of the lock ring in such a way that when the lock ring is lifted from the container, the projections come into contact and the lid plate is also lifted. On the other hand, the lock ring and lid plate may have an axial clearance such that the lock ring can be moved axially by a certain amount relative to the lid plate, e.g. when it is screwed to the container. The projection or multiple projections of the lock ring may protrude radially inward from a collar of the lock ring. When the lock ring is unscrewed and lifted, the projection or multiple projections of the lock ring protrude axially from the projection or multiple projections of the lid plate. Thus, when the lock ring is lifted, the lid plate is lifted together with the lock ring.

The lock ring and the lid plate function as one element in the axial direction. However, the lid plate is movable in the circumferential direction regarding the lock ring. Thus, the lid plate is rotatable inside the lock ring. This can be advantageous, as the lock ring with the seal ring does not move well on the container rim during closing and opening of the container closure. Because of the relative movement in the circumferential direction, the lock ring can be easily turned relative to the container rim and the container can be closed. The lid plate may be pressed onto the container rim and is not moveable in the circumferential direction because of the seal ring that sits tightly on the container rim. The lock ring in contrast is moveable in the circumferential direction and can be locked with the container rim. Thus, a closing or opening operation can be executed more ergonomically.

Preferably, lock ring and lid plate can be detached from each other when they are removed from the container, e.g. by radial elastic stretching of lock ring and lid plate and axial guiding of the projections past each other, in order to be able to clean both parts separately, for example. Both projections may form a snap connection together. Using enough force, a user can clip the lock ring and the lid plate together and separate them again.

The lid plate thus has a geometry at its (circumferential) rim which receives the container rim or can be placed on the container rim and extends on an inner side of the container rim (vertically upward) toward the upper edge of the container rim and on an outer side of the container rim in the opposite direction (downward) toward the container bottom. Thus, the edge portion of the lid plate encompasses the container rim on both sides or from the inside and from the outside. If the container wall and/or the lid plate is deformed during a drop test, the deformation does not lead to the closure becoming detached from the container or to opening of the container. Instead, the adjacent/mutually encompassing geometries and top edge deform equally and thus form a form fit. The geometry thus stabilizes the container against deformation in the drop test. The closure does not open due to the form fit. As a result, the lid plate closing the container opening is form-fitted in both radial directions via the rim geometry and force-fitted to the container in the axial direction via the lock ring, which has proven to be a very strong and tight connection in various drop tests.

In addition, the stable connection of closure and container can also withstand high stacking loads when several containers or buckets are stacked one on top of the other, in particular on the lid.

The lock ring may have a rim portion with a second receiving portion, in particular u-shaped or ∩-shaped, that receives the first receiving portion of the lid plate and encompasses it radially from the inside and outside. This also results in a radial form fit between the lock ring and the lid plate, which further increases the strength of the closure.

The lid plate may have an annular reinforcement portion radially inside the first receiving portion to reinforce the radially inner part of the first receiving portion. This means that the part of the rim portion of the lid plate that encloses the container rim from the inside may be reinforced. This allows the stacking load of the container stacked on top of the lid to be better supported on the container wall and the stacking forces to be transferred to the container wall, thus relieving the lid. Furthermore, this reinforcement stabilizes the connection between lid and container, which protects the container against deformation during the drop test.

The reinforcement portion may be formed as a circumferential, preferably v-shaped, beading with a plurality of reinforcement ribs extending in the radial direction and spaced apart in the circumferential direction, preferably V-shaped, more precisely A-shaped (in the form of an inverted V). This increases the rigidity of the lid plate, preventing the lid plate from being pressed in.

The radially outer end of the second receiving portion of the lock ring may be adjoined by a collar which reaches over the lid plate and has an (internal) thread portion which can be screwed to an (external) thread portion of a collar of the container arranged below the container rim. Since the stacking loads or impact forces are transmitted from the lock ring and the lid plate to the container via the second receiving portion, the threaded connection between lock ring and container is outside the force flow and is thus relieved.

The lock ring may have an annular contact area radially within the second receiving portion and a plurality of centering portions. The annular contact area serves for stacking an identically constructed or compatible second container on the closure. The centering portions projecting radially inward from the second receiving portion and spaced apart in the circumferential direction serve to center or laterally fix an identically constructed or compatible second container on the closure. The centering portions may be circular segment-shaped in order to receive the bottom section of a round bucket radially inside.

The lid plate may have an annular recess within the second receiving portion and a raised central portion so that the lock ring may be placed with its side opposite the contact area in the annular recess of the lid plate and the contact area of the lock ring forms a flat surface flush with the central portion of the lid plate. I.e. the lock ring and the lid plate complement each other and together form a flat outer lid surface. More precisely, the raised central portion of the lid plate corresponds to a central recess in the lock ring and completes it. This form-fit interlocking of the central portion of the lid plate with the central recess of the lock ring also prevents relative radial displacement of the lock ring and lid plate. The resulting flat surface is prepared and configured so that a further container, which is to be stacked on top of the first container, can be placed on it. In this way, the additional container stands straight and on solid ground. Tilting of the stack of containers is thus prevented or at least made less likely. Lateral slippage is prevented by the centering portions.

The second receiving portion of the lock ring may have a circumferential bulge on the inside, or more precisely on the inside of the U-shape, which, when the lock ring is screwed onto the container, presses from the outside onto the first receiving portion of the lid plate and indirectly presses the seal ring onto the upper edge of the container rim in a sealing manner. This ensures that an axial force is applied to the seal specifically at the point where the seal is located for secure sealing. This increases the contact pressure of the seal.

The lock ring may have a first radial step, in particular between the second receiving portion and the thread portion, and the container may have a second radial step, in particular between the container rim and the thread portion, which come into contact when the lock ring is screwed onto the container, i.e. serve as stops, and thus limit the screwing process. This prevents the closure from being overtightened and the thread portion from being damaged, which could impair the reusability of the lid and/or container.

Alternatively, the lock ring has a rib that projects radially inward from the circumferential collar of the lock ring. When the lock ring is screwed shut, the rib collides with a stop of the container to define an end point of the screwing process. The stop is formed on the upper sidewall portion of the container. When the lock ring is screwed onto the container, the rib is moved in the axial direction with each rotation. When the rib abuts the stop on the container, the closure is screwed shut. This limits the force or respectively the torque when screwing to prevent damage.

The lock ring may have a latching geometry and the container may have a complementary latching geometry which, when the closure is fully screwed shut, interlock in a form-fit manner and prevent rotation of the closure relative to the container. This form-fit latching prevents overtightening of the closure in one direction and serves as initial opening protection in the other direction. The latching geometry may be a recess and the latching geometry on the container may be a rib or projection. Preferably, at least one of the two latching geometries is spring-elastic, e.g. in the form of a spring tongue, whereby the form-fit closure, in particular for opening the closure, can be released by manually actuating the spring-elastic latching geometry.

The lock ring and the container may each have a feed-through which are aligned with each other when fully screwed shut, so that the lock ring and the container can be sealed with a (plug-in) anti-tamper seal. This serves on the one hand to detect whether the container has already been opened before and on the other hand to ensure that the container is also in a fully closed state.

The lock ring may have another receiving portion, in particular u-shaped or ∩-shaped, radially outside the second receiving portion, which receives a circumferential rib on the collar of the container and encloses it radially from the inside and outside. This results (in addition to the radial form fit between lock ring and lid plate) in an (additional) radial form fit between closure and container, which further relieves the thread portions that are screwed together when external loads are applied to the closure.

The sealing ring may form a first sealing point between the first receiving portion and the container rim and a second sealing point between an outer side of a container sidewall or the container rim and the first receiving portion, which encloses the container rim on its outer side. Furthermore, the lock ring may press the first receiving portion, which radially inwardly and outwardly encloses the container rim, from radially outwardly against the sealing ring and thus presses the sealing ring against the container sidewall.

Thus, two redundant sealing points are created, which improve the sealing capability of the closure. In particular, the sealing ring can be prevented from losing contact with the closure and/or the container sidewall due to deformation of either the container sidewall or the closure, and in particular the first receiving section, thus reducing the sealing effect of the sealing ring.

The combination of the external thread of the container and the internal thread of the closure ring can fix the closure ring to the cover plate in such a way that the closure ring exerts a force on the receiving section in the direction of the container rim. The force in the direction of the container rim can press the first receiving section onto the first sealing point, thus sealing it. Furthermore, the receiving section can be pressed radially inward by the collar when the threads are screwed shut. Thus, the first receiving section can exert a force on the second sealing point and press it against the outer wall of the container. As a result, when the container is closed by the container closure, the two sealing points can be particularly pressed against each other and thus improve their sealing effect.

The seal ring may also extend from the container rim along the outer sidewall of the container. Therefore, a bigger sealing area is created. The bigger sealing area can improve the sealing effect or capacity of the seal ring because loss of sealing contact in one a small area does not lead to a complete loss of sealing capacity. The bigger sealing area may also create a redundant sealing effect.

DETAILED DESCRIPTION

Figure 1:
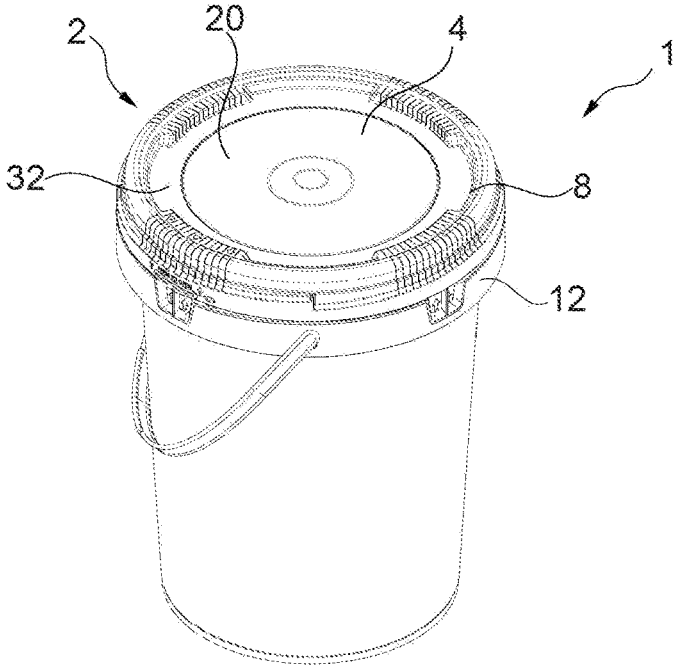
FIG. 1 shows an isometric view of a container according to the disclosure having a closure.

FIG. 1 shows a container 1. The container 1 is, for example, a round plastic bucket and is closed with a lid or closure 2. The closure 2 is rotationally symmetrical and has a lid plate 4, a seal ring 6 and a lock ring 8.

Figure 2:
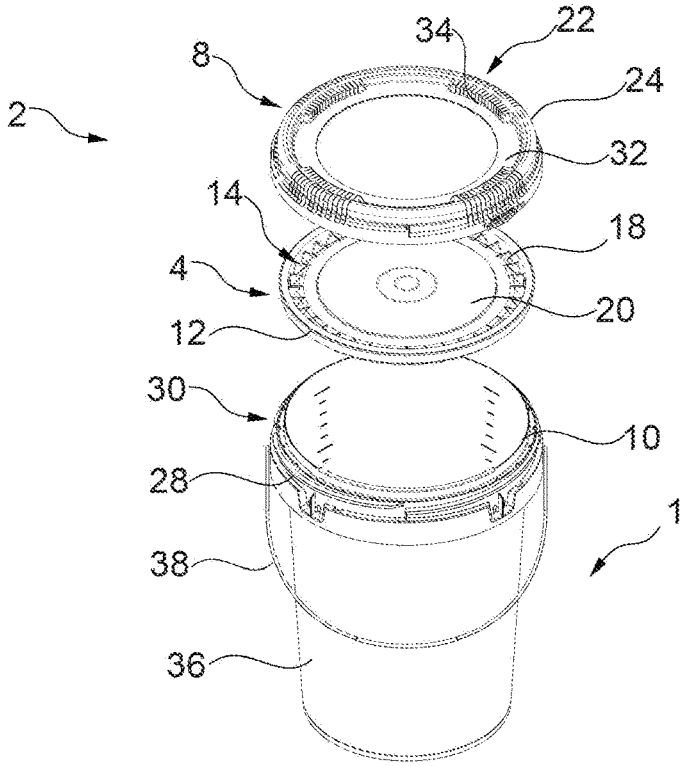
FIG. 2 shows an exploded view of the closure and the container according to the disclosure.

FIG. 2 shows an exploded view of the closure 2 and of the container 1. The lid plate 4 is placeable on a container rim 10, which bounds a container opening and covers the container opening. The lock ring 8 is in turn placeable over the lid plate 4 and screwable to the container 1. The lid plate 4 is thus fixable to the container 1 via the lock ring 8. The seal ring 6 is arranged between the container rim 10 and the lid plate 4 and seals the container opening.

The lid plate 4 has a rim portion with a first receiving portion 12, in particular u-shaped, which can receive the container rim 10. The first receiving portion 12 surrounds the container rim 10 radially from the inside and outside. The first receiving portion 12 extends vertically upward toward the container rim 10 and extends vertically downward outside the container 1 along a container wall. Inside the first receiving portion 12, the lid plate 4 has an annular reinforcement portion 14. The annular reinforcement portion 14 reinforces the radially inner part of the first receiving portion 12 and the part of the first receiving portion 12 that surrounds the container rim 10 from the inside. The reinforcement portion 14 has a circumferential beading 16. The beading 16 is preferably v-shaped. The beading 16 has a plurality of reinforcement ribs 18 extending in the radial direction and spaced apart in the circumferential direction. The reinforcement ribs 18 are preferably v-shaped and extend vertically upward from the beading 16. The lid plate 4 further has an (inner) raised central portion in the middle.

The lock ring 8 has a rim portion with a second receiving portion 22. The second receiving portion 22 is preferably u-shaped and can receive the u-shaped first receiving portion 12 of the lid plate 4. Thereby, the second receiving portion 22 encompasses the first receiving portion 12 radially from the inside and outside due to its U-shape. The lock ring 8 has a collar 24 at the radially outer end of the second receiving portion 22, wherein the collar 24 engages over the lid plate 4. The collar 24 protrudes (vertically downward) from the second receiving portion 22. The collar 24 protrudes in the direction of the container 1. The collar 24 has an internal thread portion 26, which can be screwed to an external thread portion 28 of a collar 30 of the container 1 arranged below the container rim 10.

The lock ring 8 further includes an annular contact area 32 radially inside the second receiving portion 22 for stacking an identically constructed or compatible second container 1 on the closure 2. A plurality of centering portions 34 project radially inward from the second receiving portion 22. The centering portions 34 are circumferentially spaced and center the identically constructed or compatible second container 1 on the closure 2. A side (axially) opposite the contact area 32 rests on the lid surface of the lid plate 4. The central portion 20 of the lid plate 4 is flush with the contact area 32 of the lock ring 8. The raised central portion 20 of the lid plate 4 corresponds to a central recess in the lock ring 8 and completes it to a common (planar) surface (shown in FIG. 1). The lid plate 4 has a kind of recess radially outside the central portion 20 in which the contact area 32 rests.

The container 1 is approximately cylindrical, has a round container bottom, a container wall 36 which projects vertically from the container bottom, and the upper container rim 10 which bounds the (round) container opening. The container wall 36 has at its upper end the collar 30 which protrudes radially from the rest of the container wall 36. The collar 30 has the external thread portion 28 for screwing the closure 2 onto the container 1. The container 1 further comprises a handle 38 for carrying the container 1. The handle 38 is rotatably attached to the collar 30.

Figure 3:
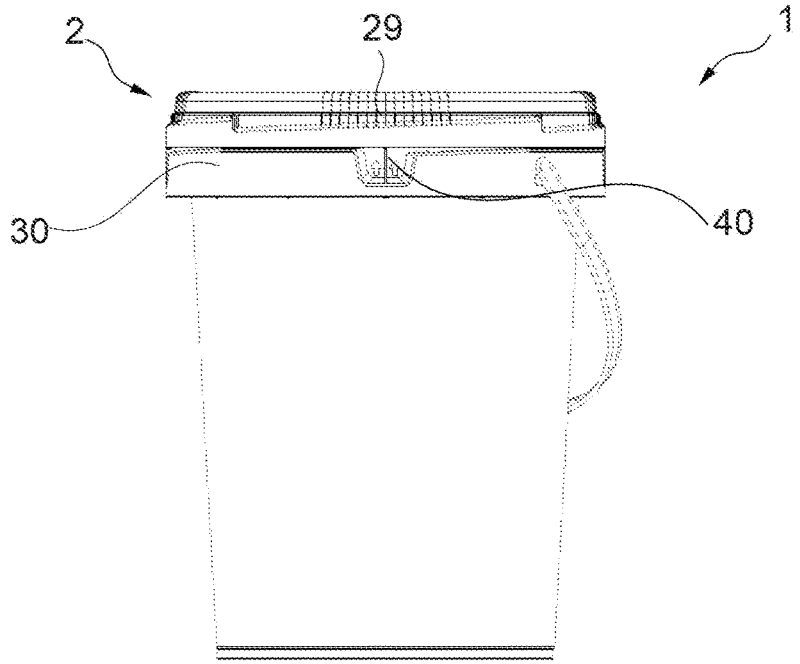
FIG. 3 shows a side view of the container according to the disclosure having the closure.
Figure 4:
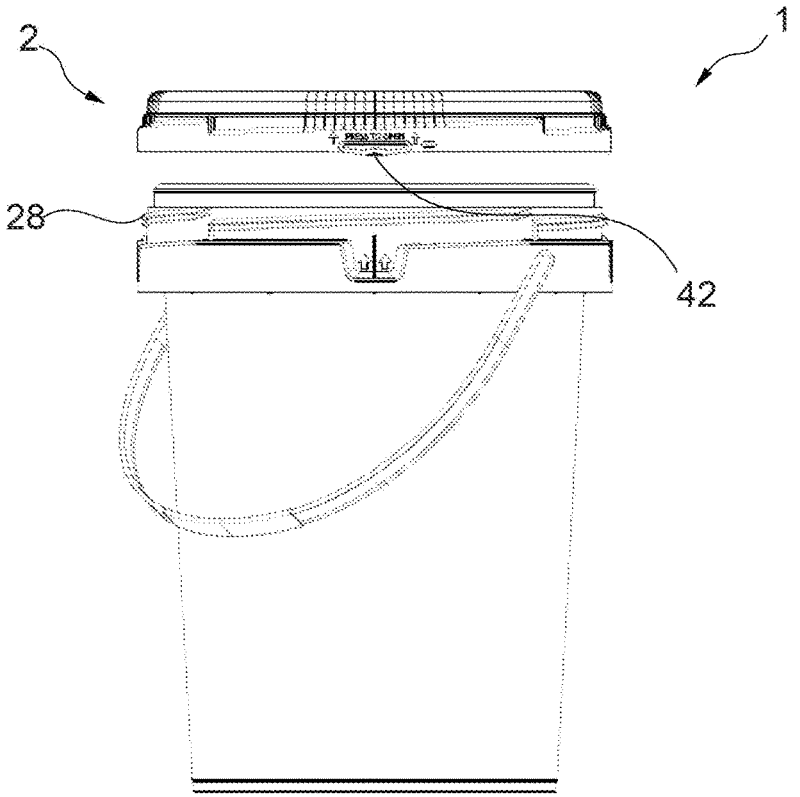
FIG. 4 shows a side view of the container according to the disclosure with a raised closure.
Figure 5:
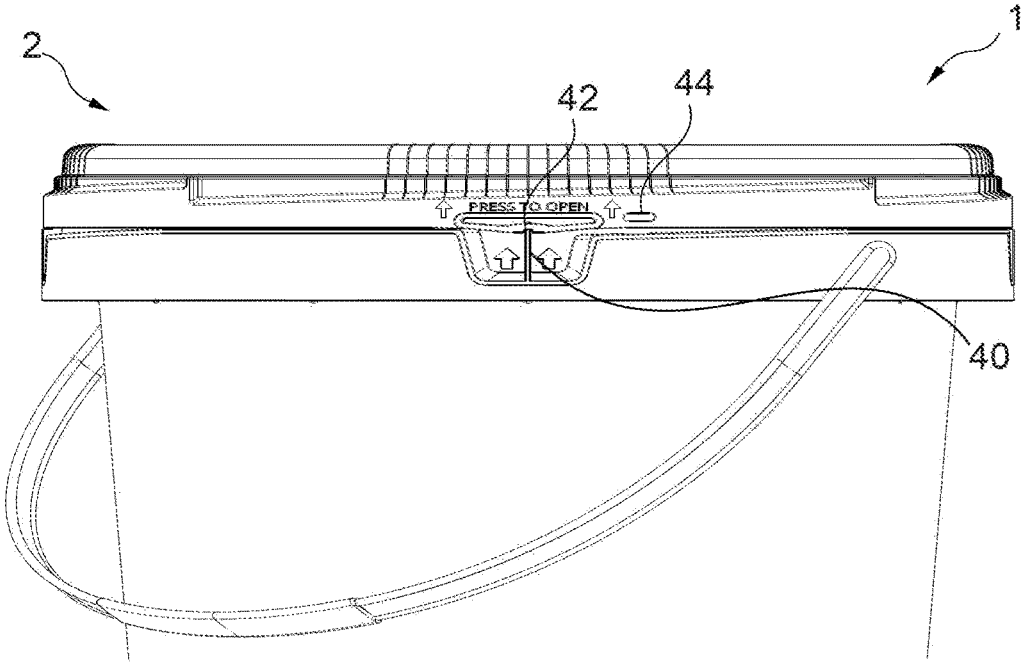
FIG. 5 shows a detailed side view of the container according to the disclosure.

FIG. 3 shows a side view of the container 1. The container 1 has a latching geometry, in particular a rib/projection 40. The rib 40 is formed on an upper side of the collar 30 of the container 1 and preferably extends vertically upward toward the closure 2. FIG. 4 shows a side view of the opened closure 2. The closure 2 is rotated compared to FIG. 3. The external thread portion 28 of the container 1 is shown. The lock ring 8 has a latching geometry, in particular a recess 42. The latching geometry of the lock ring 8 is complementary to the latching geometry of the container 1. When the closure 2 is fully screwed shut, the rib 40 of the container 1 engages in a form-fit manner in the latching geometry (recess 42) of the lock ring 8. This engagement prevents relative rotation of the closure 2 with respect to the container 1, wherein at least one of the latching geometries is configured in a spring-elastic manner and the form-fit closure can thus be released, in particular for opening the closure 2. The engagement is shown in the detailed view of a side view of the closed container 1 in FIG. 5. In addition, the lock ring 8 and the container 1 each have a feed-through 44, which are aligned with each other when fully screwed shut, so that the lock ring 8 and the container 1 can be sealed with an anti-tamper seal 46.

Figure 6:
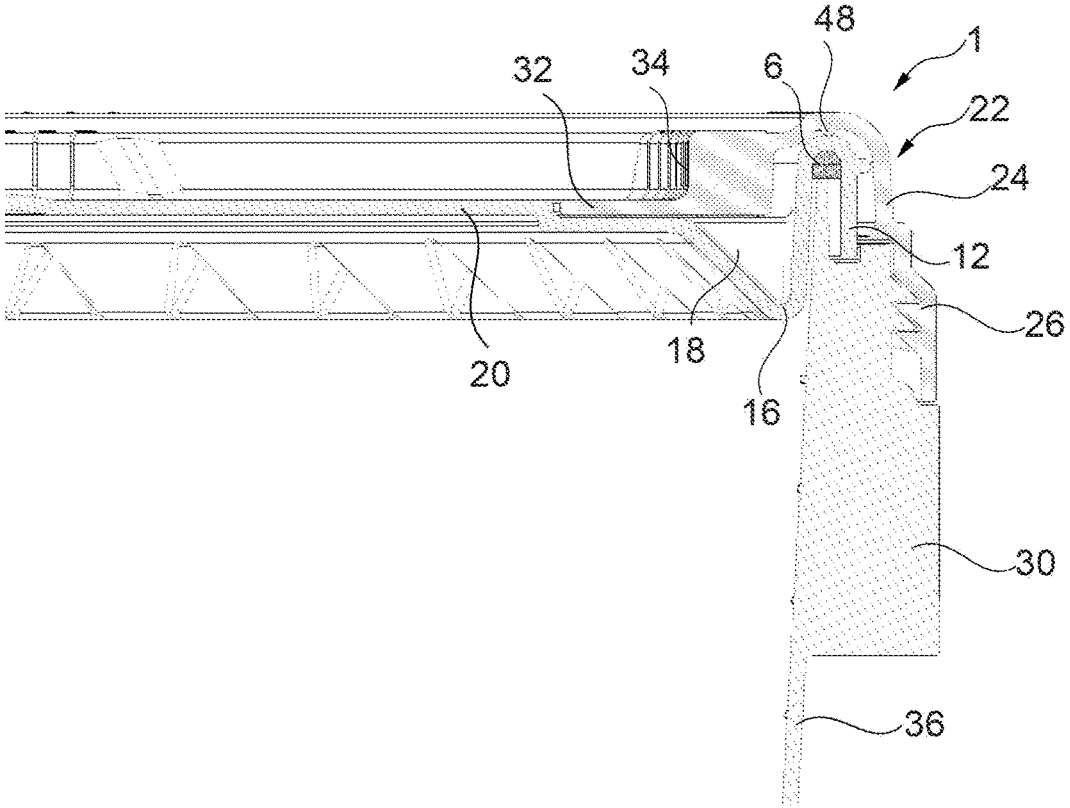
FIG. 6 shows a sectional view through the container according to the disclosure with a seal ring according to a first embodiment.

FIG. 6 shows a section of a longitudinal cross-section through the closure 2 on the container 1. The lid plate 4 has the central portion 20 extending from the inside to the radially outside. The beading 16 with the reinforcement ribs 18 is arranged radially outward adjacent to the central portion 20. The first receiving portion 12 encloses the container rim 10 from radially inside and outside. To this end, the first receiving portion 12 extends vertically upward toward the container rim 10 and extends vertically downward in the opposite direction outside the container 1. Thus, the first receiving portion 12 extends outside the container 1 along the container rim 10. Thus, the first receiving portion 12 forms the u-shape or the shape of an inverted U.

The lock ring 8 has the contact area 32 radially on the inside, which extends radially inward from the second receiving portion 22. The lock ring 8 has the centering elements 34 radially outside the contact area 32. The second receiving portion 22 is adjacent to this radially on the outside. The lock ring 8 has the collar 24 at the radially outer end of the second receiving portion 22. The internal thread portion 26 is arranged on the collar 24 and screws the lock ring 8 to the external thread portion 28 of the container 1.

The second receiving portion 22 of the lock ring 8 has a circumferential bulge 48 on the inside which, when the lock ring 8 is screwed onto the container 1, presses from the outside onto the first receiving portion 12 of the lid plate 4 and presses the seal ring 6 in a sealing manner onto the upper edge of the container rim 10. The bulge 48 is thereby positioned inside the u-shaped second receiving portion 22 and extends vertically downward. The lock ring 8 has a radial step 50 arranged in particular between the second receiving portion 22 and the thread portion 26. The container 1 also has a radial step 52 positioned in particular between the container rim 10 and the thread portion 28. The radial steps 50, 52 contact each other when the lock ring 8 is screwed onto the container 1 and thus limit the screwing process.

The lid plate 4 has a circumferential projection 54 or multiple projections provided in the circumferential direction, which interact in a form-fit manner with a circumferential projection 56 or multiple projections provided in the circumferential direction or a rib on the lock ring 8 in the axial direction. As a result, when the lock ring 8 is lifted from the container 1, the projections 54, 56 come into contact and the lid plate 4 is lifted with the lock ring 8. The lock ring 8 and the lid plate 4 have such an axial clearance that the lock ring 8 can be moved axially by a certain amount relative to the lid plate 4, for example when it is screwed to the container. Nevertheless, the lock ring 8 and the lid plate 4 can be detached from each other when they are removed from the container.

The lock ring 8 may also have another, in particular u-shaped, receiving portion radially outside the second receiving portion 22, which receives a circumferential rib on the collar 30 of the container 1 and encompasses it radially from the inside and outside.

In a first embodiment shown in FIG. 6, the seal ring 6 has a semicircular cross-sectional shape. The seal ring 6 is compressed between the receiving portion 12 and the container rim 10 and seals the container opening. When the seal ring 6 is compressed, one sealing point on the container rim 10 is established. However, the seal ring 6 can take different shapes.

Figure 7:
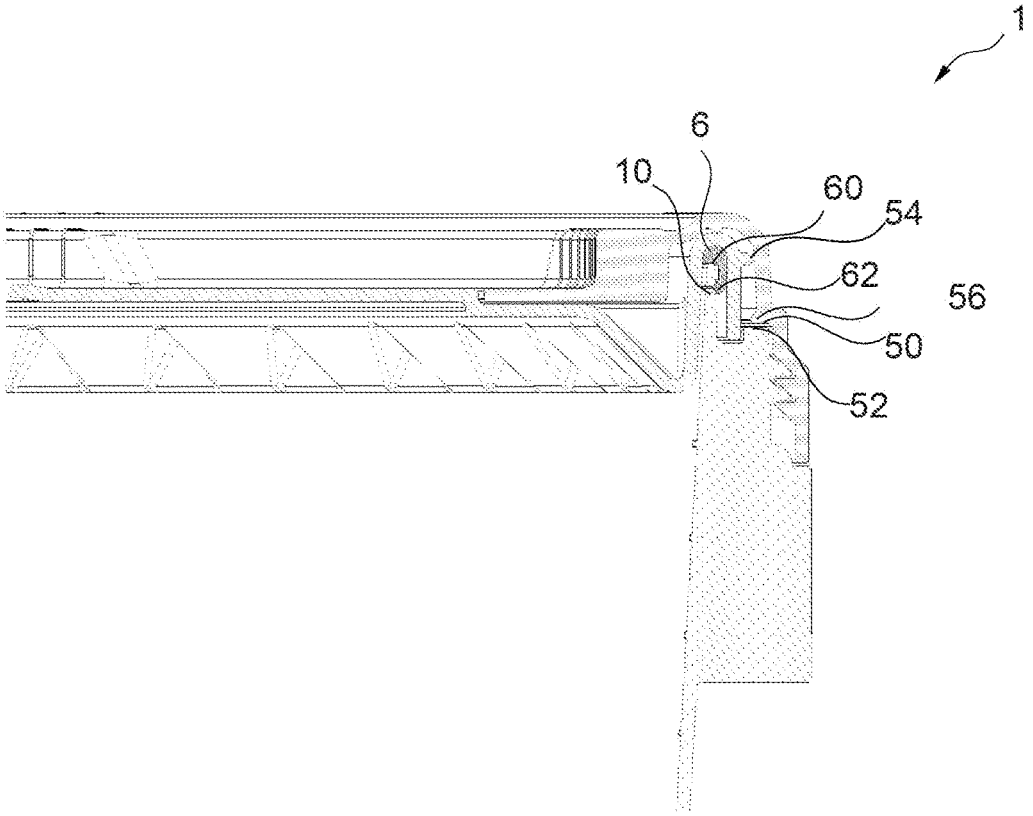
FIG. 7 shows a sectional view through the container according to the disclosure with a seal ring according to a second embodiment.

FIG. 7 shows the seal ring 6 according to a further embodiment. In this embodiment, the seal ring 6 extends along the container rim 10. The seal ring 6 has two separate sealing points. A first sealing point 60 is positioned between the container rim 10 and the first receiving portion 12 of the lid plate 4. A second sealing point 62 is positioned between an outer surface of the container or container rim 10 and the inner surface of the first receiving portion 12. Thus, the second sealing point 62 is positioned on the inner surface of the u-shaped arm of the first receiving portion 12 that extends along the outer side of the container rim 10. Two sealing points can seal the container closure 2 better than one and therefore may increase the sealing capacity of the seal ring 6. Especially, when one sealing point loses its contact with the container 1 or lid plate 4, the other redundant sealing point can still prevent a loss of sealing capacity.

Figure 8:
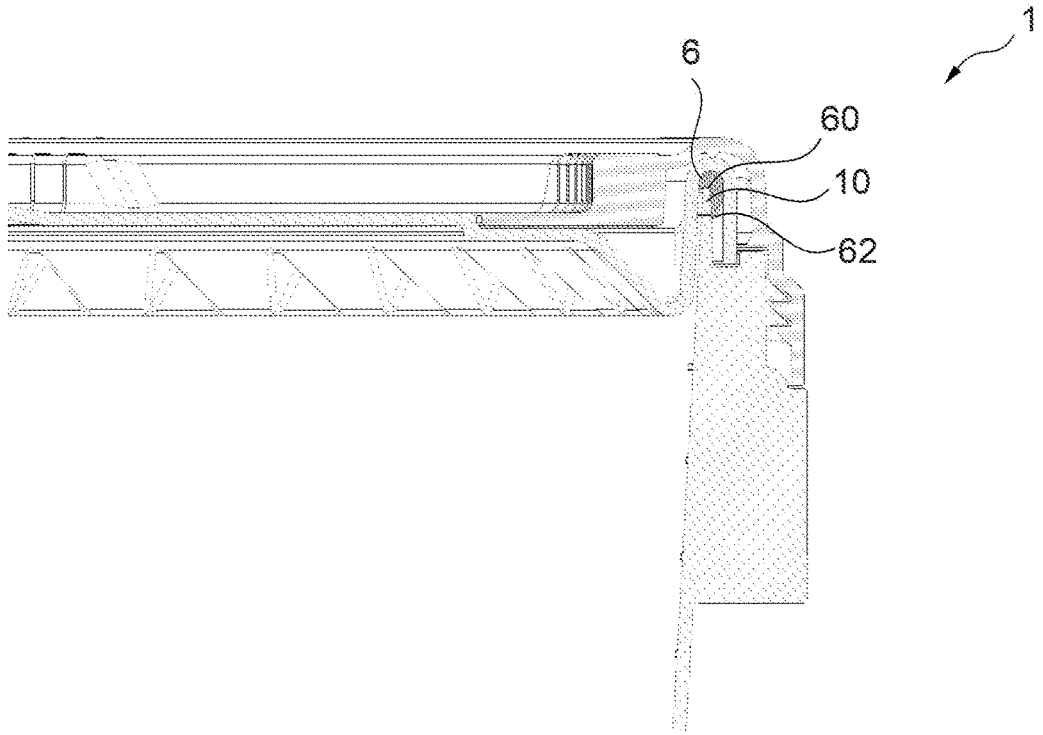
FIG. 8 shows a sectional view through the container according to the disclosure with a seal ring according to a third embodiment.

FIG. 8 shows the seal ring 6 according to a further embodiment. The seal ring 6 is drop-shaped and extends along the container rim 10. In this way, the seal ring 6 ensures that no liquid can drip out of the container 1. The drop-shaped seal ring 6 may establish the two separate sealing points 60, 62 that are spaced apart from each other. However, the two separate sealing points 60, 62 can also be combined into one single longer sealing line or sealing surface. The long sealing surface may increase the sealing capacity of the seal ring 6.

Figure 9:
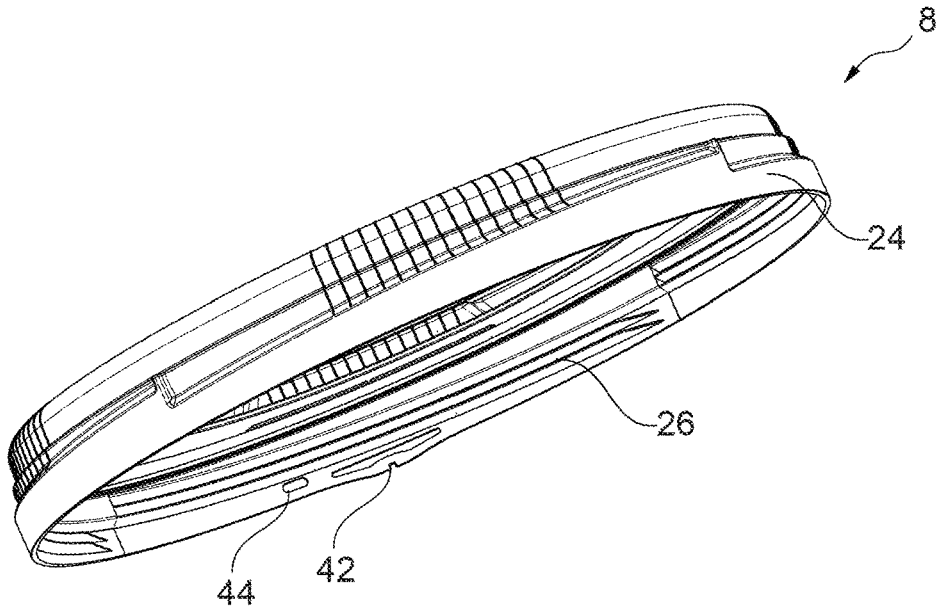
FIG. 9 shows an isometric view of the lock ring.

FIG. 9 shows an isometric view of the lock ring 8. The collar 24 protrudes from the contact area 32. The internal thread portion 26 is arranged inside the collar 24. The (spring-elastic) recess 42 is arranged at one end of the collar 24. The recess 42 is compressible in an (axial) direction, i.e. toward or away from the container 1. For this purpose, the recess 42 is configured, for example, as a spring tongue. As a result of the compression, the rib 40 and the recess 42 are no longer in mutual engagement and the closure 2 can be screwed open. In the circumferential direction of the lock ring 8, the feed-through 44 for the anti-tamper seal 46 (shown in FIG. 11) is arranged next to the recess 42.

Figure 10:
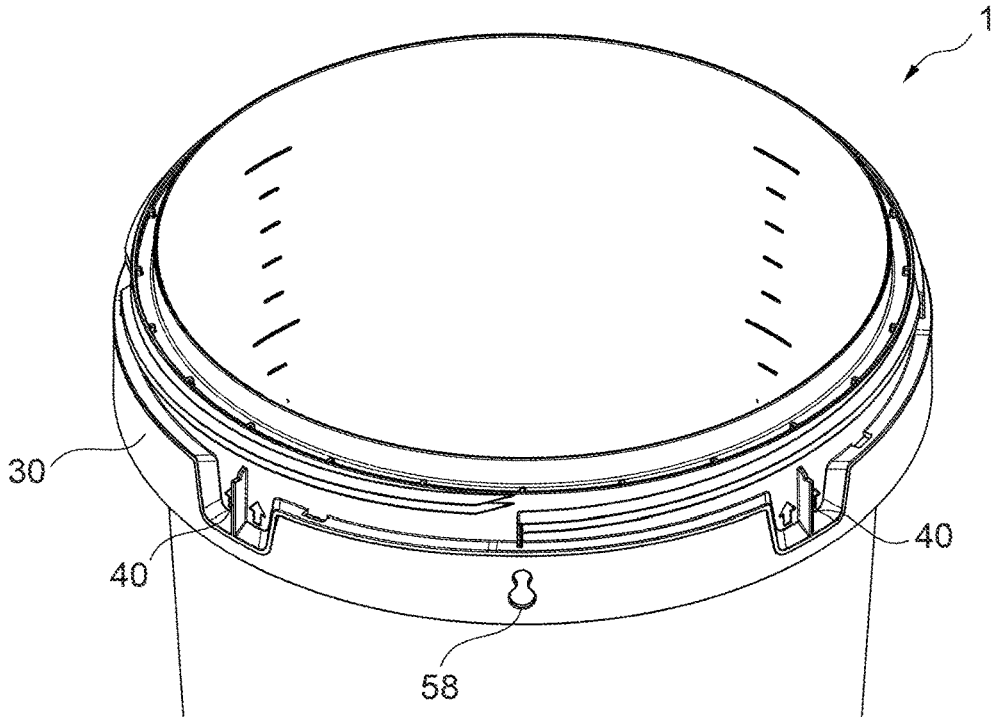
FIG. 10 shows an isometric view of an open container according to the disclosure.
Figure 11:
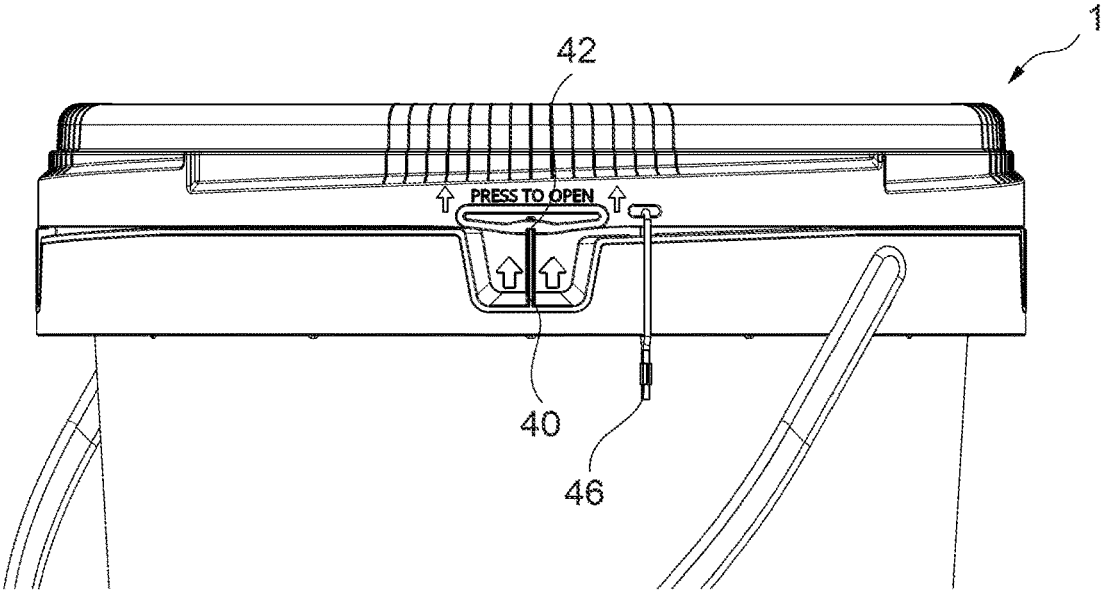
FIG. 11 shows a detailed side view of the closed container with the closure.
Figure 12:
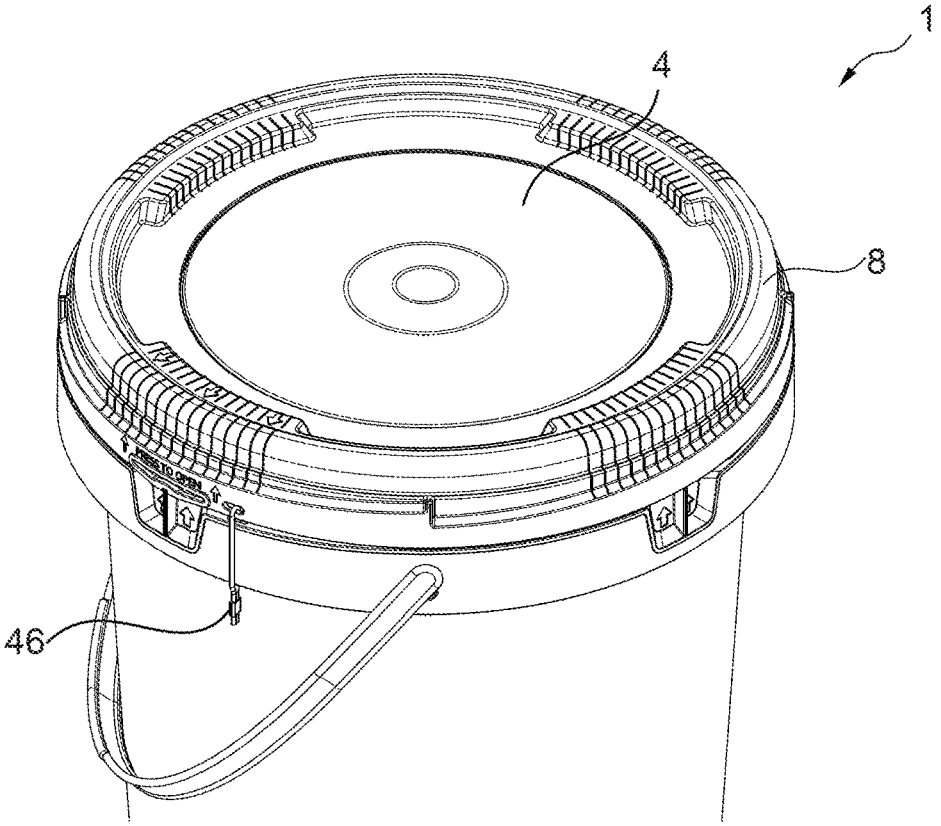
FIG. 12 shows an isometric view of the closed container.

FIG. 10 shows the open container 1. The plurality of ribs 40 are formed on the collar 30 projecting radially outward from the container wall 36. The ribs 40 are preferably arranged vertically. The collar 30 also has a holder 58 for the handle 38. FIG. 11 shows in particular the rib 40 engaged with the recess 42. The anti-tamper seal 46 is drawn through the aligned feed-throughs 44 and functions as a seal. The seal can be used to determine whether the container 1 has already been opened. FIG. 12 shows an isometric view of the closed container 1. The plurality of ribs 40 and the plurality of recesses 42 are each engaged with each other. The plurality of ribs 40 are engaged with the plurality of recesses 42.

Figure 13:
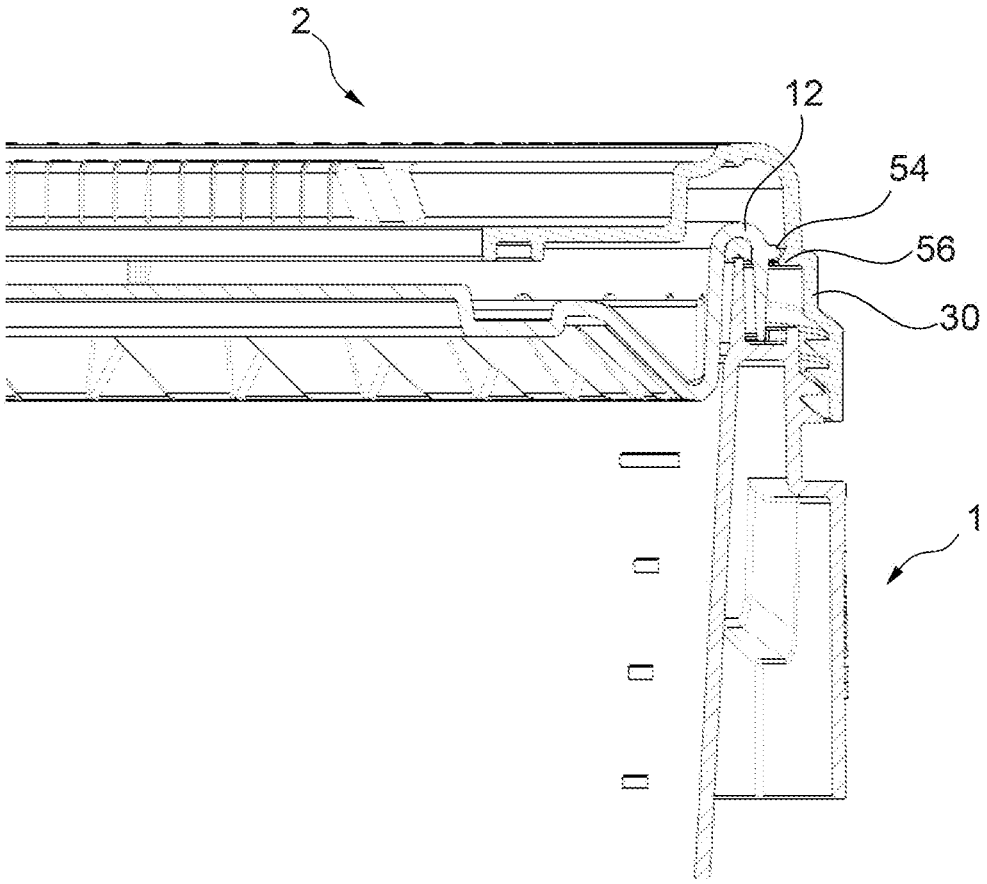
FIG. 13 shows a sectional view through the container according to the disclosure with the closure partially open.

FIG. 13 shows the closure 2 partially unscrewed from the container 1. The projection 54 of the lid plate 4 protrudes radially outward from the first receiving portion 12. The projection 56 of the lock ring 8 projects radially inward from the collar 30. The two projections 54, 56 interact in such a way that they are both in axial contact with each other when the lock ring 8 is unscrewed. This is also shown in FIG. 13. If the lock ring 8 is then lifted upward, the projection 56 takes the lid plate 4 with it. The lid plate 4 is thus lifted off together with the lock ring 8.

The invention claimed is:

1. A container comprising:

a container rim bounding a container opening; and a closure comprising:

a lid plate that is closed and placeable on the container rim to cover the container opening;

a lock ring that is placeable over the lid plate and screwable to the container, the lid plate being fixable to the container via the lock ring; and a seal ring arranged between the container rim and the lid plate for sealing the container opening, the lid plate comprising a first rim portion with a first receiving portion that receives the container rim and encompasses the container rim radially from inside and outside, the lid plate further comprising at least one first projection provided in a circumferential direction protruding radially outward from the first receiving portion, the lock ring comprising at least one second projection provided in the circumferential direction protruding radially inward towards the first receiving portion, and the at least one first projection and the at least one second projection interacting in a form-fitting manner in an axial direction during an opening of the container and the lid plate is lifted with the lock ring, the lock ring comprising a second rim portion with a second receiving portion that receives the first receiving portion of the lid plate and encompasses the first receiving portion radially from inside and outside, the lock ring defining an annular contact area for stacking an identically constructed or compatible second container on the closure, a plurality of centering portions projecting radially inwardly from the second receiving portion and spaced apart in the circumferential direction for centering the identically constructed or compatible second container on the closure, the annular contact area and the plurality of centering portions extending radially inwardly from the second receiving portion, the lock ring resting with a side opposite the annular contact area in an annular recess in the lid plate on a lid surface, and the lid plate comprising a raised central portion that is flush with the annular contact area.

2. The container according to claim 1, wherein the lid plate has a reinforcement portion that is annular and extends radially inside the first receiving portion to reinforce a radially inner part of the first receiving portion enclosing the container rim from the inside, wherein the reinforcement portion is formed as a circumferential beading with a plurality of reinforcement ribs extending in a radial direction and spaced apart in the circumferential direction.

3. The container according to claim 2, wherein the reinforcement portion is v-shaped.

4. The container according to claim 3, wherein the second receiving portion is u-shaped.

5. The container according to claim 2, wherein the reinforcement ribs are v-shaped.

6. The container according to claim 1, wherein a radially outer end of the second receiving portion is adjoined by a first collar that reaches over the lid plate and has an internal thread portion that is screwable to an external thread portion of a second collar of the container arranged below the container rim.

7. The container according to claim 6, wherein the lock ring has a first radial step and the container has a second radial step that contacts the first radial step when the lock ring is screwed onto the container, limiting rotation of the lock ring relative to the container.

8. The container according to claim 7, wherein the first radial step is arranged between the second receiving portion and the internal thread portion.

9. The container according to claim 7, wherein the second radial step is arranged between the container rim and the external thread portion.

10. The container according to claim 1, wherein the second receiving portion has a circumferential bulge on an inside which, when the lock ring is screwed onto the container, presses from the outside onto the first receiving portion and presses the seal ring onto an upper edge of the container rim in a sealing manner.

11. The container according to claim 1, wherein:

the lock ring has a first latching geometry and the container has a second latching geometry that interlocks with the first latching geometry in a form-fit engagement when the closure is fully screwed shut to prevent rotation of the closure relative to the container, and wherein at least one of the first latching geometry and the second latching geometry is spring-elastic such that the form-fit engagement is releasable.

12. The container according to claim 11, wherein the first latching geometry is a recess.

13. The container according to claim 11, wherein the second latching geometry is a rib.

14. The container according to claim 1, further comprising a first feed-through and a second feed-through that are aligned when the closure is fully screwed shut, so that the lock ring and the container are sealable with an anti-tamper seal.

15. The container according to claim 1, wherein the container is made from plastic.

16. The container according to claim 1, wherein the container comprises a bucket or the first receiving portion is u-shaped.

17. The container according to claim 1, wherein the lid plate is retained within the lock ring by the at least one second projection of the lock ring, the lid plate being retained in an axially movable arrangement in which the lock ring is axially movable relative to the lid plate.

18. The container according to claim 17, wherein the lock ring is axially movable relative to the lid plate between a first position, in which the at least one second projection of the lock ring directly engages the at least one first projection of the lid plate, and a second position, in which the at least one second projection of the lock ring is axially spaced from the at least one first projection of the lid plate.

19. A container comprising:

a container rim bounding a container opening; and a closure comprising:

a lid plate that is closed and placeable on the container rim to cover the container opening;

a lock ring that is placeable over the lid plate and screwable to the container, the lid plate being fixable to the container via the lock ring; and a seal arranged between the container rim and the lid plate for sealing the container opening, the lid plate comprising a first rim portion with a first receiving portion that receives the container rim and encompasses the container rim radially from inside and outside, the lock ring comprising a second rim portion with a second receiving portion that axially receives the first receiving portion of the lid plate and encompasses the first receiving portion radially from inside and outside, the lock ring comprising an annular contact area that extends radially inwardly from the second rim portion to form a stacking surface for stacking an identically constructed or compatible second container on the lock ring, the annular contact area comprising a resting surface opposite the stacking surface, the resting surface configured to rest on the lid plate, the lid plate being connected to the lock ring in an axially movable arrangement in which the lock ring is axially movable relative to the lid plate between a first axial position, in which the resting surface directly contacts the lid plate, and a second axial position, in which the resting surface is axially spaced from the lid plate by an axial clearance.

20. The container according to claim 19, wherein:

the lid plate comprises at least one first projection provided in a circumferential direction and protruding radially outwardly from the first receiving portion, the lock ring comprises at least one second projection provided in the circumferential direction and protruding radially inwardly towards the annular contact area, the at least one second projection of the lock ring directly engages the at least one first projection of the lid plate when the lock ring is in the first axial position, and the at least one second projection of the lock ring is axially spaced from the at least one first projection of the lid plate when the lock ring is in the second axial position.

* * * * *